US010993494B2

(12) United States Patent
Teat et al.

(10) Patent No.: US 10,993,494 B2
(45) Date of Patent: May 4, 2021

(54) COMBINATION SURGICAL CAP AND DEPLOYABLE BOUFFANT CAP

(71) Applicant: O&M Halyard, Inc., Mechanicsville, VA (US)

(72) Inventors: Stephanie V. Teat, Roswell, GA (US); Kun-Chi Wu, Johns Creek, GA (US); Patrick F. Elliott, Dunwoody, GA (US); Brian E. Lin, Cumming, GA (US); Mary Rachel Taylor Henderson, Decatur, GA (US); Matthew G. Weatherly, Tuacon, AZ (US); Peymaun Ghafouri-Kia, Alpharetta, GA (US); Ann Shupe, Walker, MI (US); Karen Duncan, Wyoming, MI (US)

(73) Assignee: O&M Halyard, Inc., Mechanicsville, VA (US)

( * ) Notice: Subject to any disclaimer, the term of this patent is extended or adjusted under 35 U.S.C. 154(b) by 162 days.

(21) Appl. No.: 16/100,298

(22) Filed: Aug. 10, 2018

(65) Prior Publication Data

US 2019/0045864 A1 Feb. 14, 2019

Related U.S. Application Data

(60) Provisional application No. 62/628,453, filed on Feb. 9, 2018, provisional application No. 62/544,048, filed on Aug. 11, 2017.

(51) Int. Cl.
*A41D 1/00* (2018.01)
*A42B 1/012* (2021.01)
(Continued)

(52) U.S. Cl.
CPC ..... *A42B 1/012* (2021.01); *A42B 1/0186* (2021.01); *A42B 1/0187* (2021.01); *A42B 1/225* (2013.01);
(Continued)

(58) Field of Classification Search
CPC ..... A42B 1/043; A42B 1/225; A42B 1/067; A42B 1/241; A42B 1/066; A41D 2023/004
See application file for complete search history.

(56) References Cited

U.S. PATENT DOCUMENTS 576,294 A * 2/1897 Waliner ..... A42B 1/066 2/172
D133,490 S * 8/1942 Burns ..... D2/867
(Continued)

FOREIGN PATENT DOCUMENTS

CN 202697843 U 1/2013
CN 205671558 U 11/2016
(Continued)

OTHER PUBLICATIONS

International Search Report and Written Opinion for PCT/IB2018/056063, dated Nov. 30, 2018, 11 pages.

*Primary Examiner* — Khaled Annis
(74) *Attorney, Agent, or Firm* — Dority & Manning, P.A.

(57) ABSTRACT

A head cover that can be worn by health care professionals is provided. The head cover includes a surgical cap portion and a bouffant cap portion. The surgical cap portion includes a top surface and a side panel secured to the top surface via a seam. Further, the bouffant cap portion is secured to a rear portion of the side panel, where the bouffant cap portion is maintained against the rear portion of the side panel in an undeployed state and is deployable from the rear portion of the side panel to contain a wearer's hair. As such, the head cover enables a wearer to secure his or her hair inside the
(Continued)

bouffant cap as needed, yet bouffant cap portion does not cover the wearer's entire head, which minimizes the amount of heat that is trapped within the head cover and increases the level of comfort for the wearer.

21 Claims, 18 Drawing Sheets

(51) Int. Cl.

| | |
|---|---|
| ***A42B 1/241*** | (2021.01) |
| ***A42B 1/22*** | (2006.01) |
| ***A42B 1/0186*** | (2021.01) |
| ***A42B 1/0187*** | (2021.01) |
| *A41D 23/00* | (2006.01) |

(52) U.S. Cl.
CPC ..... *A42B 1/241* (2013.01); *A41D 2023/004* (2013.01)

(56) References Cited

U.S. PATENT DOCUMENTS 2,666,925 A 1/1954 Mayer
2,817,090 A 12/1957 Toellner
3,035,273 A * 5/1962 Krystal ..... A42B 1/066 2/172
3,249,948 A 5/1966 Eppolito
3,555,565 A * 1/1971 Zimmon ..... A42B 1/043 2/195.7
3,741,202 A * 6/1973 Morgan ..... A61F 13/122 606/204.35
4,041,203 A 8/1977 Brock et al.
4,378,606 A * 4/1983 Snowden ..... A42B 1/041 2/200.1
4,453,276 A * 6/1984 Smith ..... A42B 1/043 2/200.1
4,491,985 A 1/1985 Dalton
4,852,186 A * 8/1989 Landis ..... A61F 9/02 2/9
5,159,720 A 11/1992 Scott, Jr.
5,161,260 A 11/1992 Reynolds
5,355,535 A 10/1994 Bruder
5,493,732 A * 2/1996 Fawkes ..... A42B 1/066 2/195.1
5,649,327 A 7/1997 Crewe
5,685,017 A 11/1997 Kraft
5,860,165 A * 1/1999 Cvijanovich ..... A42B 1/066 2/172
5,920,909 A 7/1999 Ellsworth et al.
5,996,124 A * 12/1999 Asp, Jr. ..... A42B 1/241 2/172
6,021,525 A 2/2000 Mertins
6,163,886 A 12/2000 Carter
6,317,892 B1 * 11/2001 Galigani ..... A42B 1/201 2/209.11
6,481,020 B1 11/2002 Kirkland
6,557,179 B1 * 5/2003 Reuven ..... A42B 1/008 2/171.2
D539,011 S 3/2007 Molesky
D572,438 S * 7/2008 Chun ..... D2/883
D572,879 S * 7/2008 Marquardt ..... D2/867
7,437,777 B2 * 10/2008 Marquardt ..... A42B 1/043 2/202
D591,485 S 5/2009 Cho
D624,284 S * 9/2010 Creel ..... D2/867
8,024,818 B1 9/2011 Davenport
D715,033 S * 10/2014 Barr ..... D2/883
9,237,776 B2 1/2016 Kang
9,439,466 B2 9/2016 Woo
2002/0035745 A1 * 3/2002 Spell ..... A42B 1/008 2/209.13
2005/0144702 A1 7/2005 Whitney
2006/0003154 A1 1/2006 Snowden et al.
2006/0048277 A1 * 3/2006 Yeadon ..... A42B 1/041 2/204
2006/0272073 A1 12/2006 Marquardt
2007/0033707 A1 * 2/2007 Stone ..... A42B 1/066 2/209
2007/0214545 A1 * 9/2007 Rhodes ..... A42B 1/041 2/207
2008/0196144 A1 * 8/2008 Ruiz ..... A41D 13/1236 2/171
2008/0272318 A1 * 11/2008 Cadwalader ..... G06Q 30/0215 250/516.1
2010/0016775 A1 * 1/2010 Cumming ..... A61F 13/12 602/60
2010/0294301 A1 * 11/2010 Blasingame ..... A45D 8/40 132/274
2011/0145976 A1 * 6/2011 Osgood ..... A42B 3/10 2/174
2011/0272604 A1 * 11/2011 Cohen ..... A42B 1/008 250/516.1
2011/0272605 A1 * 11/2011 Cohen ..... A42B 1/008 250/516.1
2012/0317699 A1 * 12/2012 Barr ..... A42B 1/067 2/209.13
2012/0324627 A1 * 12/2012 Adkins ..... A42B 1/041 2/209.13
2013/0007944 A1 * 1/2013 Touray ..... A42B 1/061 2/181
2013/0185844 A1 * 7/2013 Moore ..... A42B 1/241 2/209.13
2014/0026284 A1 1/2014 Yates
2014/0299795 A1 10/2014 Cohen
2014/0359918 A1 12/2014 Oates
2015/0150327 A1 * 6/2015 Scott ..... A42B 1/12 2/68
2015/0305471 A1 * 10/2015 Jude ..... A45D 19/16 132/200
2016/0058089 A1 * 3/2016 Niedrich ..... A42B 1/22 2/172
2016/0128411 A1 * 5/2016 Ayres ..... A42B 1/241 2/172
2016/0174645 A1 * 6/2016 Goldner ..... A41G 5/004 132/53
2016/0198830 A1 * 7/2016 Tussey ..... A42B 1/041 2/183
2017/0000651 A1 * 1/2017 Cumming ..... A61F 13/00038
2017/0246041 A1 * 8/2017 Cumming ..... A61F 13/00017
2018/0007987 A1 * 1/2018 Robertson ..... A41G 3/0016
2018/0007989 A1 * 1/2018 Genender ..... B29C 65/565
2018/0014596 A1 * 1/2018 Washington ..... A42B 1/067
2018/0249804 A1 * 9/2018 Walker ..... A45D 20/18
2019/0037944 A1 * 2/2019 Tussey ..... A42B 1/12

FOREIGN PATENT DOCUMENTS

CN 206275198 U 6/2017
DE 7931662 U1 2/1980
DE 102016103508 A1 10/2016
GB 353685 A 7/1931
JP 2002242019 A 8/2002
JP 3110940 U 7/2005
JP 3125153 U 9/2006
JP 2010126866 A 6/2010
JP 3162955 U 9/2010
KR 200366134 Y1 11/2004

* cited by examiner

COMBINATION SURGICAL CAP AND DEPLOYABLE BOUFFANT CAP

RELATED APPLICATIONS

The present application claims priority to U.S. Provisional Application Ser. No. 62/544,048, filed on Aug. 11, 2017 and U.S. Provisional Application Ser. No. 62/628,453, filed on Feb. 9, 2018, which are incorporated herein in their entirety by reference thereto.

FIELD OF THE INVENTION

The subject matter of the present invention relates generally to personal protective equipment (PPE) in the form a head cover worn by health care professionals.

BACKGROUND

Health care professionals often wear a surgeon's cap, a bouffant cap (i.e., hair net), or both during medical procedures to prevent contact with hazardous materials such as blood or other bodily fluids. In addition, health care professionals are often required to wear a surgeon's cap or a bouffant cap (i.e., hair net) to cover their hair to protect the sterile environment. Moreover, the Association of Registered Nurses (AORN) Guidelines are undergoing revisions, and it is now recommended that head coverings should cover the head, hair, ears, facial hair, and nape of the neck to not only protect health care professionals but to maintain a sterile environment as well. However, traditional surgeon's caps do not cover the ears or the nape of the neck, requiring health care professionals to also don a bouffant cap or hair net to try to cover these regions. Bouffant caps add an additional layer of PPE which can trap heat and increase bulk. Further, bouffant caps are prone to leave red marks and indentations on the forehead after use due to the use of an elastic band to secure the bouffant caps around the head.

One solution is to don a bouffant cap only instead of a bouffant cap and surgeon's cap. However, bouffant caps generally cannot support the use of headlamps or other equipment that may be used by a health care professional. Hence, it is necessary to don both a bouffant cap and a surgeon's cap, as the surgeon's cap has sufficient bulk and structure to support headlamps and other equipment. Nevertheless, problems also exist with the use of a surgeon's cap. Namely, typical surgeon's caps only come in a few sizes and do not provide a secure enough fit for many health care professionals. In addition, although surgeon's caps may be outfitted with ties, the repetition of tying a surgeon's cap to secure its fit over an extended time period can lead to shoulder pain and other issues.

Consequently, there is a need for a head cover that overcomes the aforementioned shortcomings of existing surgeon's caps and bouffant caps. In particular, a head cover that covers a health care professional's hair without the need to wear a surgeon's cap and a full bouffant cap would also be useful.

SUMMARY

The present invention is directed to a head cover. The head cover includes a surgical cap portion and a bouffant cap portion. The surgical cap portion includes a top surface and a side panel secured to the top surface via a seam. Further, the bouffant cap portion is secured to a rear portion of the side panel, where the bouffant cap portion is maintained against the rear portion of the side panel in an undeployed state and is deployable from the rear portion of the side panel to contain a wearer's hair.

In one particular embodiment, the side panel can be a continuous section of material that completely encircles the circumference of the top surface, further wherein a series of pleats, an elastic band, or both are present adjacent a lower edge of the side panel. Further, the series of pleats, the elastic band, or both can be present at the rear portion of the side panel or below an ear portion of the side panel.

In addition, when the series of pleats, the elastic band, or both are present at the rear portion of the side panel, the bouffant cap portion can be positioned above the elastic band, the series of pleats, or both by a distance D. For instance, the distance D can range from about 0.25 centimeters (cm) to about 6 cm.

In one more embodiment, an exterior flap can contain the bouffant cap portion of the head cover until the bouffant cap portion of the head cover is deployed.

In still another embodiment, the side panel can extend between a first end and a second end, wherein a fastening means can be disposed on the first end or the second end. Further, the fastening means can include hooks, loops, or a combination thereof.

In yet another embodiment, the bouffant cap portion can have a circumference, wherein a series of gathers are present at the circumference of the bouffant cap portion. Moreover, a part of the circumference of the bouffant cap portion can be secured to a body-facing surface of the rear portion of the side panel.

In yet another embodiment, the top surface of the surgical cap portion can be adjacent the wearer's head.

In an additional embodiment, the bouffant cap portion of the head cover and the top surface of the surgical cap portion do not overlap.

In one more embodiment, the bouffant cap portion of the head cover is not visible until it is deployed.

In one particular embodiment, the side panel of the surgical cap portion can include a laminate. For instance, the laminate can be a spunbond-meltblown-spunbond material.

In one more embodiment, the side panel of the surgical cap portion can include a spunbond material or a cotton woven material.

In another embodiment, the top surface of the surgical cap portion can include a spunbond material, a spunbond-meltblown-spunbond material, or a cotton woven material.

In still another embodiment, the bouffant cap portion can include a spunbond material.

In yet another embodiment, the side panel can extend beyond the wearer's ears. Further, a portion of the side panel covering the wearer's ears can include a spunbond material, a spunbond-meltblown-spunbond material, or a cotton woven material.

In one more embodiment, a pair of ties is disposed on the side panel.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
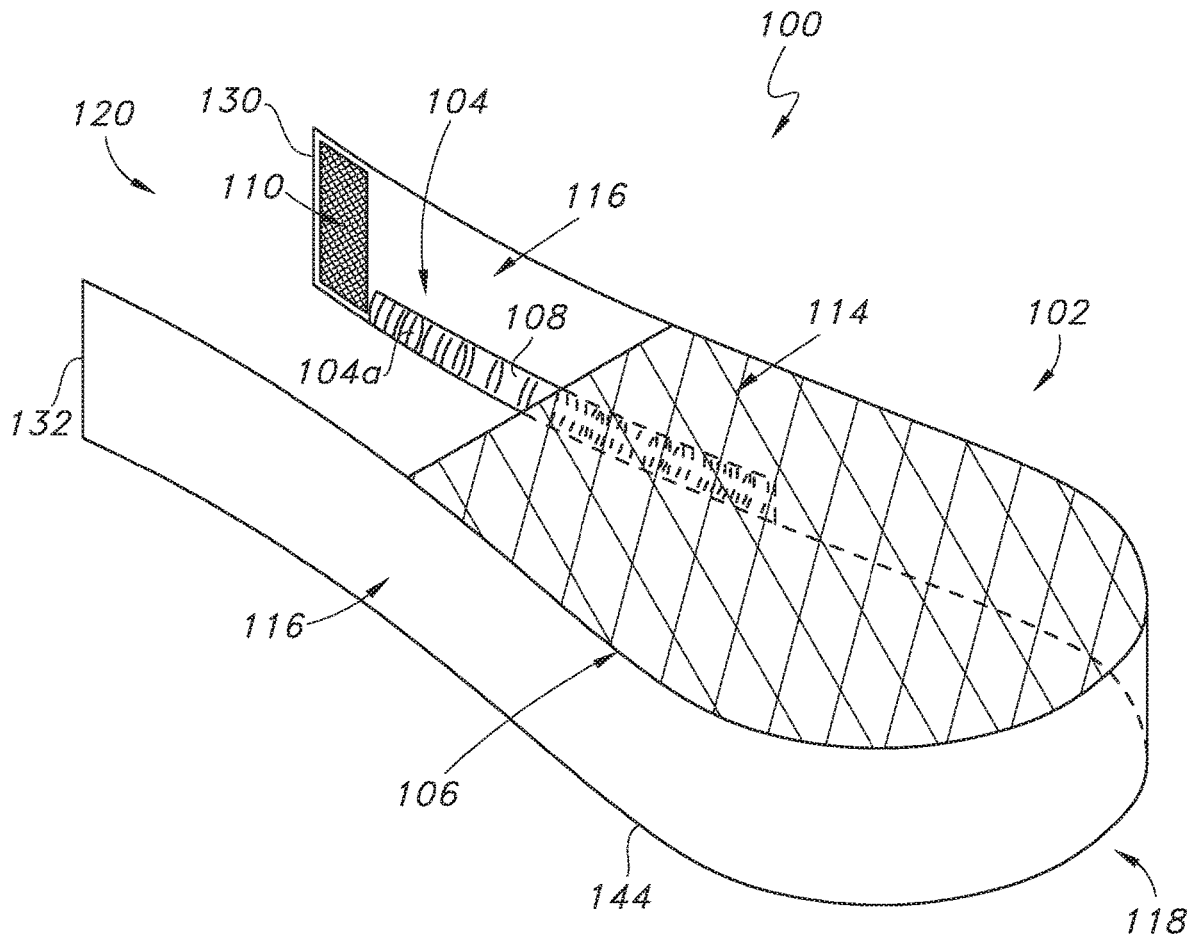
FIG. 1 is a perspective view of a head cover according to one particular embodiment of the present invention before the head cover has been donned and secured about the head of a wearer.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally speaking, the present invention is directed to a head cover that can be worn by health care professionals. The head cover includes a surgical cap portion and a bouffant cap portion. The surgical cap portion includes a top surface and a side panel secured to the top surface via a seam. Further, the bouffant cap portion is secured to a rear portion of the side panel, further wherein the bouffant cap portion is maintained against the rear portion of the side panel in an undeployed state and is deployable from the rear portion of the side panel to contain a wearer's hair. As such, the head cover enables a wearer to secure his or her hair inside the bouffant cap portion as needed, yet bouffant cap portion does not cover the wearer's entire head, which minimizes the amount of heat that is trapped within the head cover and increases the level of comfort for the wearer. Furthermore, because the bouffant cap portion is only present at the lower edge of the surgical cap portion, the bouffant cap portion does not leave red marks on the wearer's forehead, which is a problem associated with current head covers. In addition, because the head cover also incorporates a surgical cap portion, the head cover has sufficient structure to support a headlamp or any other accessory that the wearer may need to wear around his or her head during a medical procedure, while a bouffant cap alone may shift or become unstable and hinder the use of such accessories. Moreover, because the head cover can utilize a fastening means such as hooks, loops, or a combination thereof, or because the head cover can include an elastic band secured to a continuous side panel of the surgical cap portion to ensure a snug yet comfortable fit, the need to use ties to secure the head cover is eliminated, which can minimize the occurrence of shoulder pain experienced by many health care professionals due to the repetitive motion of tying. The specific features of the head cover of the present invention may be better understood with reference to FIGS. 1-10.

Referring now to FIG. 1, one embodiment of a head cover 100 contemplated by the present invention is shown before the head cover 100 has been donned and secured about the head of a wearer. The head cover 100 has an anterior portion 118 that is positioned about a forehead of a wearer and a posterior portion 120 that can be secured about the back of the head or neck of the wearer. The head cover 100 also includes a surgical cap portion 102 and a bouffant cap portion 104. The surgical cap portion 102 includes a top surface 114 and a side panel 116. In one embodiment, the top surface 114 and the side panel 116 can be joined together at a seam 106 that encircles the circumference 140 of the top surface 114. The side panel 116 extends between a first end 130 and a second end 132. The first end 130 includes a fastening means 110, which can be in the form of hooks, loops, or a combination thereof, or any other suitable fastening mechanism such as a tape, adhesive, etc. Moreover, it is to be understood that although the fastening means 110 is shown as being present on the first end 130, the fastening means 110 could be present on the second end 132 in the alternative, or both the first end 130 and the second end 132 could include the fastening means 110.

Turning now to the bouffant cap portion 104, the bouffant cap portion 104 is shown in an undeployed state 104*a* in FIG. 1, where the bouffant cap portion 104 includes gathers 108 and is folded into position against the side panel 116. The bouffant cap portion 104 is secured to the side panel 116 towards the posterior portion 120 of the head cover 100 and is positioned near a lower edge 144 of the side panel 116. The manner in which the bouffant cap portion 104 can be deployed to contain a wearer's hair is discussed in more detail with respect to FIGS. 2 and 3.

Figure 2:
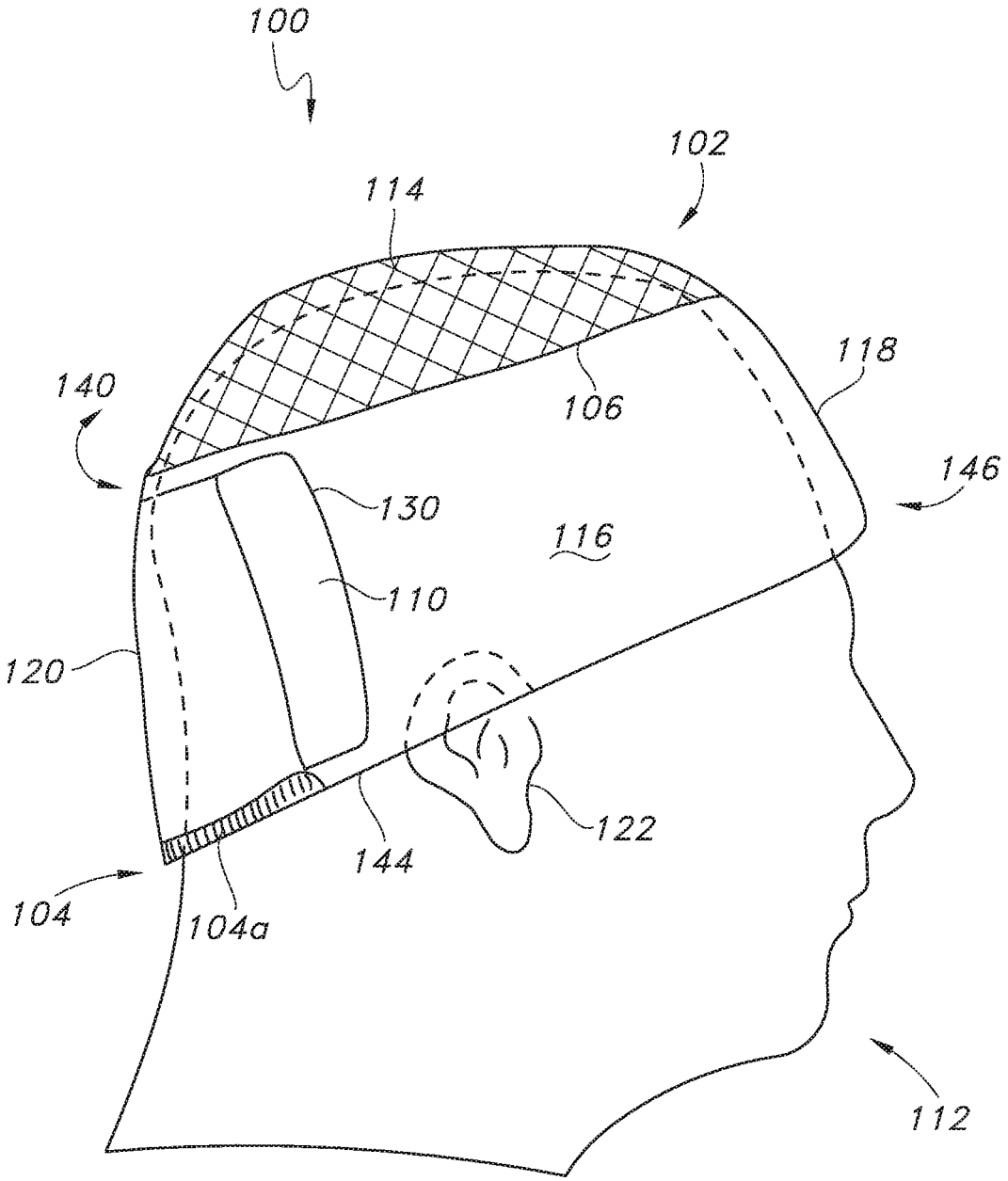
FIG. 2 is a side view of the head cover of FIG. 1 after it has been donned by a wearer.
Figure 3:
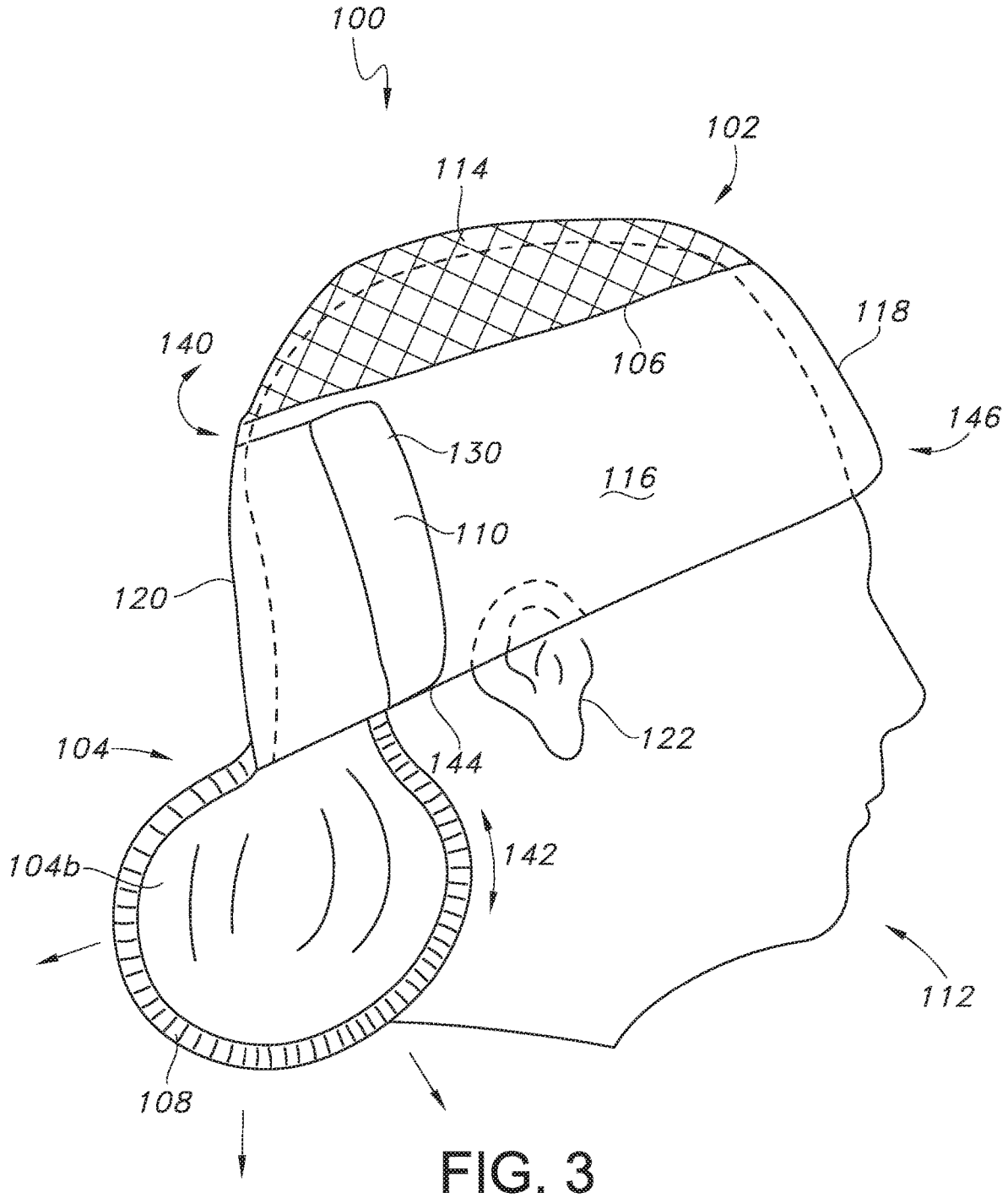
FIG. 3 is a side view of the head cover of FIG. 1 and FIG. 2 after the bouffant cap portion of the head cover has been deployed from the posterior portion of the surgical cap portion of the head cover.

Specifically, FIG. 2 is a side view of the head cover 100 of FIG. 1 after it has been donned by a wearer 112, while FIG. 3 is a side view of the head cover 100 of FIG. 1 after the bouffant cap portion 104 of the head cover has been deployed from the posterior portion 120 of the surgical cap portion 102 of the head cover 100. As shown in FIG. 2, the side panel 116 wraps around the wearer 112's head 146 such that the first end 130 is secured to the side panel 116 via the fastening means 110 near the posterior portion 120 of the head cover 100. Further, the bouffant cap portion 104 is in an undeployed state 104*a* and is contained within the side panel 116 at edge 144 such that the bouffant cap portion 104 is not visible. The edge 144 of the side panel 116 encircles the wearer 112's head and covers a portion of the wearer 112's ear 122.

Next, FIG. 3 shows the head cover 100 after the bouffant cap portion 104 has been used to contain the wearer 112's hair such that the bouffant cap portion 104 is in a deployed state 104*b*. As shown, the bouffant cap portion 104 extends beyond the edge 144 of the side panel 116 so as to contain hair that may extend outside the surgical cap portion 102 of the head cover 100. The circumference 142 of the bouffant cap portion 104 contains gathers 108 that provide the bouffant cap portion 104 with some elasticity to enable the bouffant cap portion 104 to securely contain the wearer 112's hair. The bouffant cap portion 104 can be deployed in any suitable manner, such as by the wearer 112 grasping the gathers 108 and gently pulling downward to secure the bouffant cap portion 104 around his or her hair.

Figure 4:
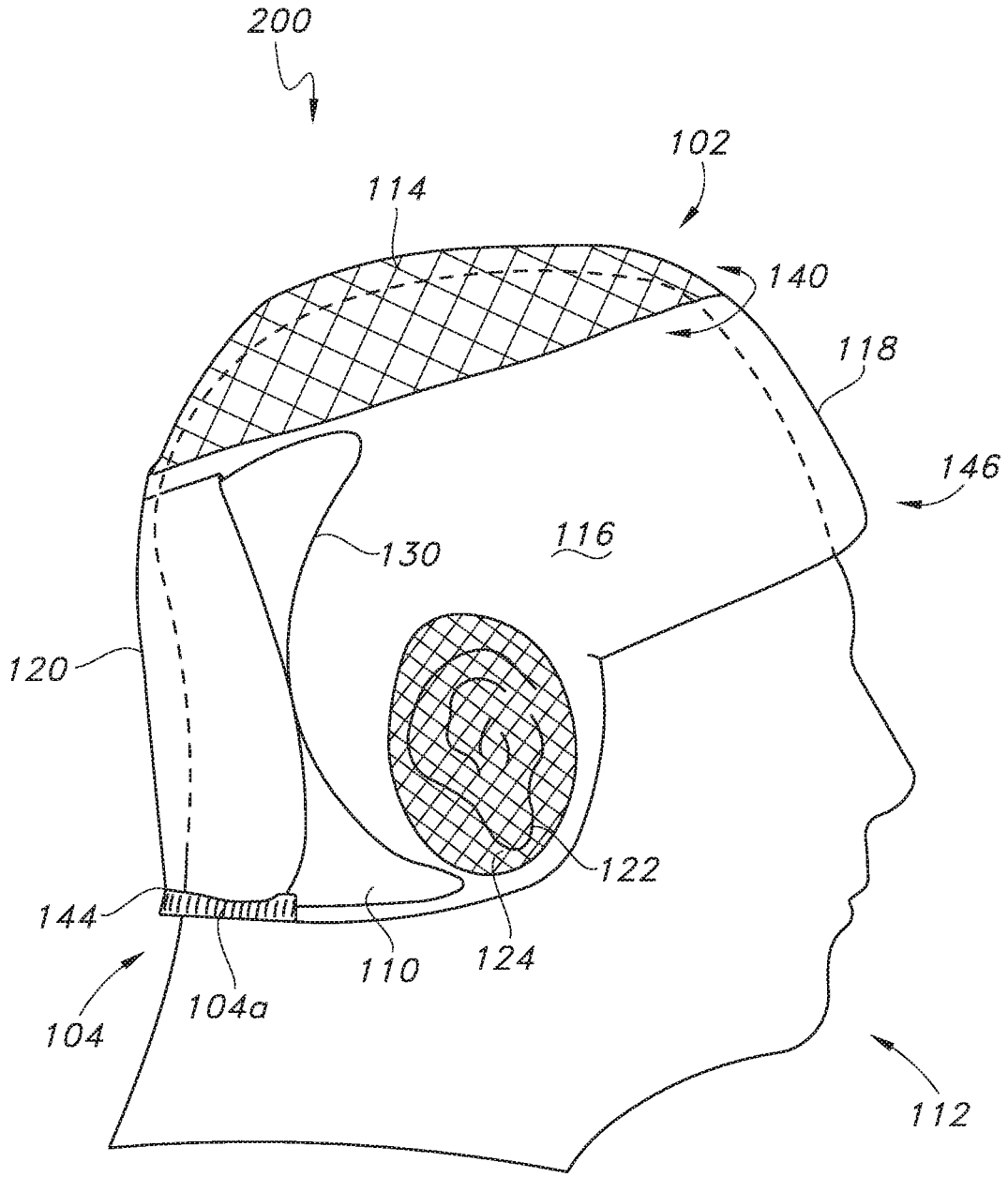
FIG. 4 is a side view of a head cover according to one another particular embodiment of the present invention after the head cover has been donned by a wearer.
Figure 5:
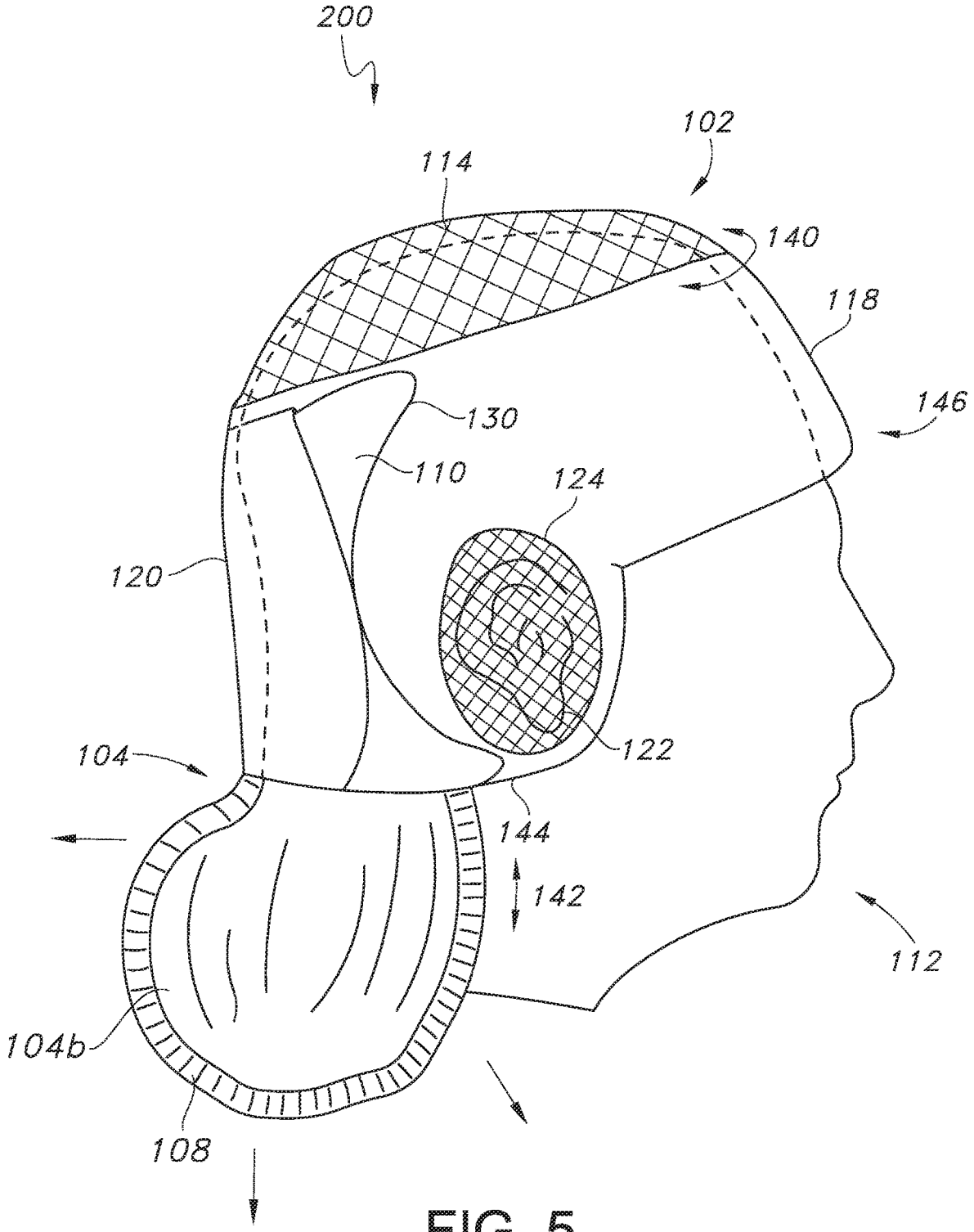
FIG. 5 is a side view of the head cover of FIG. 4 after the bouffant cap portion of the head cover has been deployed from the posterior portion of the surgical cap portion of the head cover.

FIG. 4 is a side view of another embodiment of a head cover 200 after it has been donned by a wearer 112, while FIG. 5 is a side view of the head cover 200 of FIG. 4 after the bouffant cap portion 104 of the head cover has been deployed from the posterior portion 120 of the surgical cap portion 102 of the head cover 100. As shown in FIG. 4, the side panel 116 wraps around the wearer 112's head 146 such that the first end 130 is secured to the side panel 116 via the fastening means 110 near the posterior portion 120 of the head cover 102. Further, the bouffant cap portion 104 is in an undeployed state 104*a* and is contained within the side panel 116 at edge 144 such that the bouffant cap portion 104 is not visible. The edge 144 of the side panel 116 encircles the wearer 112's head and is designed such that it covers the entirety of the wearer 112's ear 122. Further, the side panel 116 can include an ear portion 124 that is formed from a different material than the remainder of the side panel 116. For instance, the ear portion 124 can be formed from a material that is thinner than the rest of the side panel 116 so as to not obstruct the wearer's ability to hear when wearing the head cover 200.

Next, similar to FIG. 3 described above, FIG. 5 shows the head cover 200 after the bouffant cap portion 104 has been used to contain the wearer 112's hair such that the bouffant cap portion 104 is in a deployed state 104*b*. As shown, the bouffant cap portion 104 extends beyond the edge 144 of the side panel 116 so as to contain hair that may extend outside the surgical cap portion 102 of the head cover 100. The circumference 142 of the bouffant cap portion 104 contains gathers 108 that provide the bouffant cap portion 104 with some elasticity to enable the bouffant cap portion 104 to securely contain the wearer 112's hair. The bouffant cap portion 104 can be deployed in any suitable manner, such as by the wearer 112 grasping the gathers 108 and gently pulling downward to secure the bouffant cap portion 104 around his or her hair.

Figure 6:
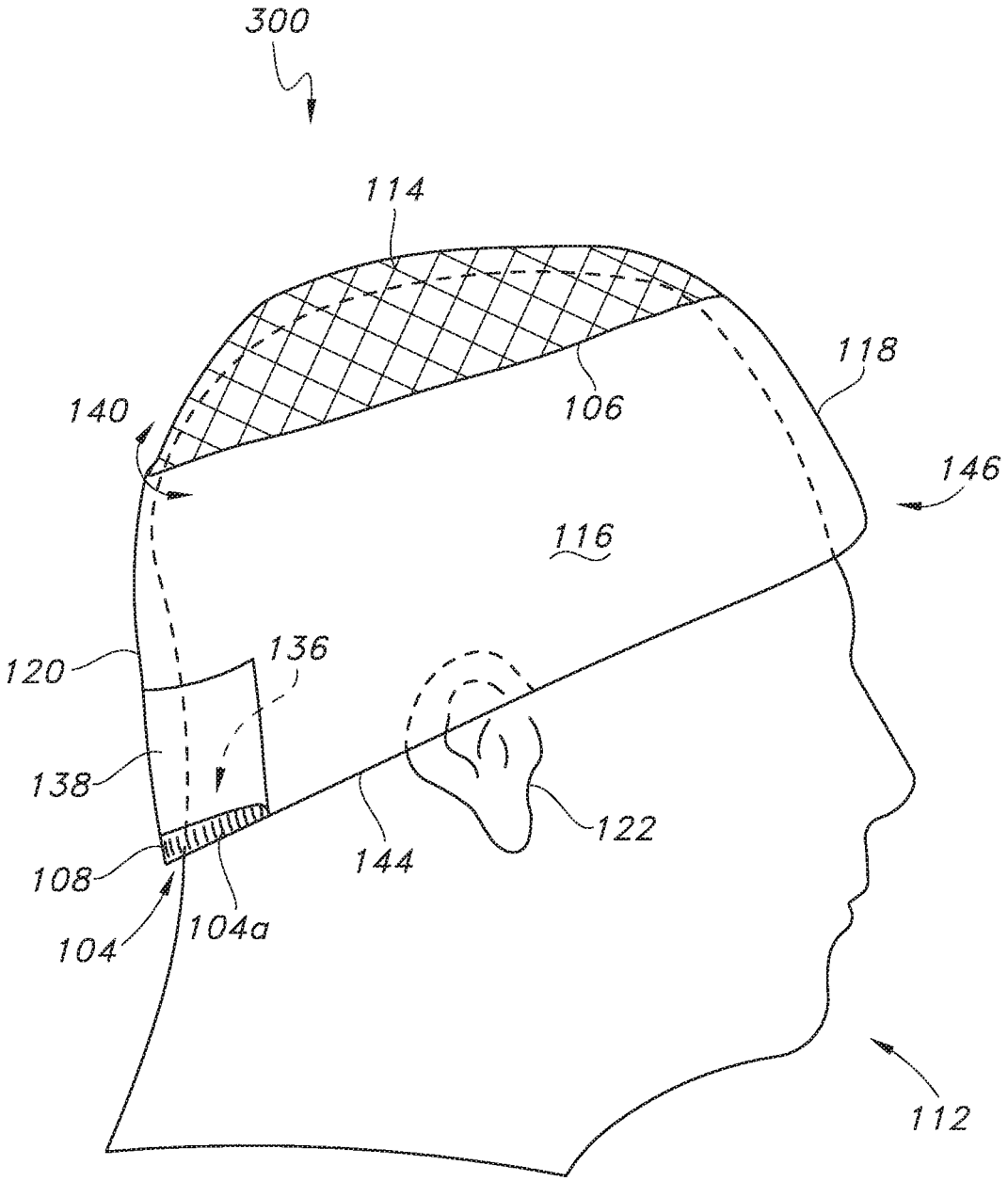
FIG. 6 is a side view of a head cover according to one another particular embodiment of the present invention after the head cover has been donned by a wearer.
Figure 7:
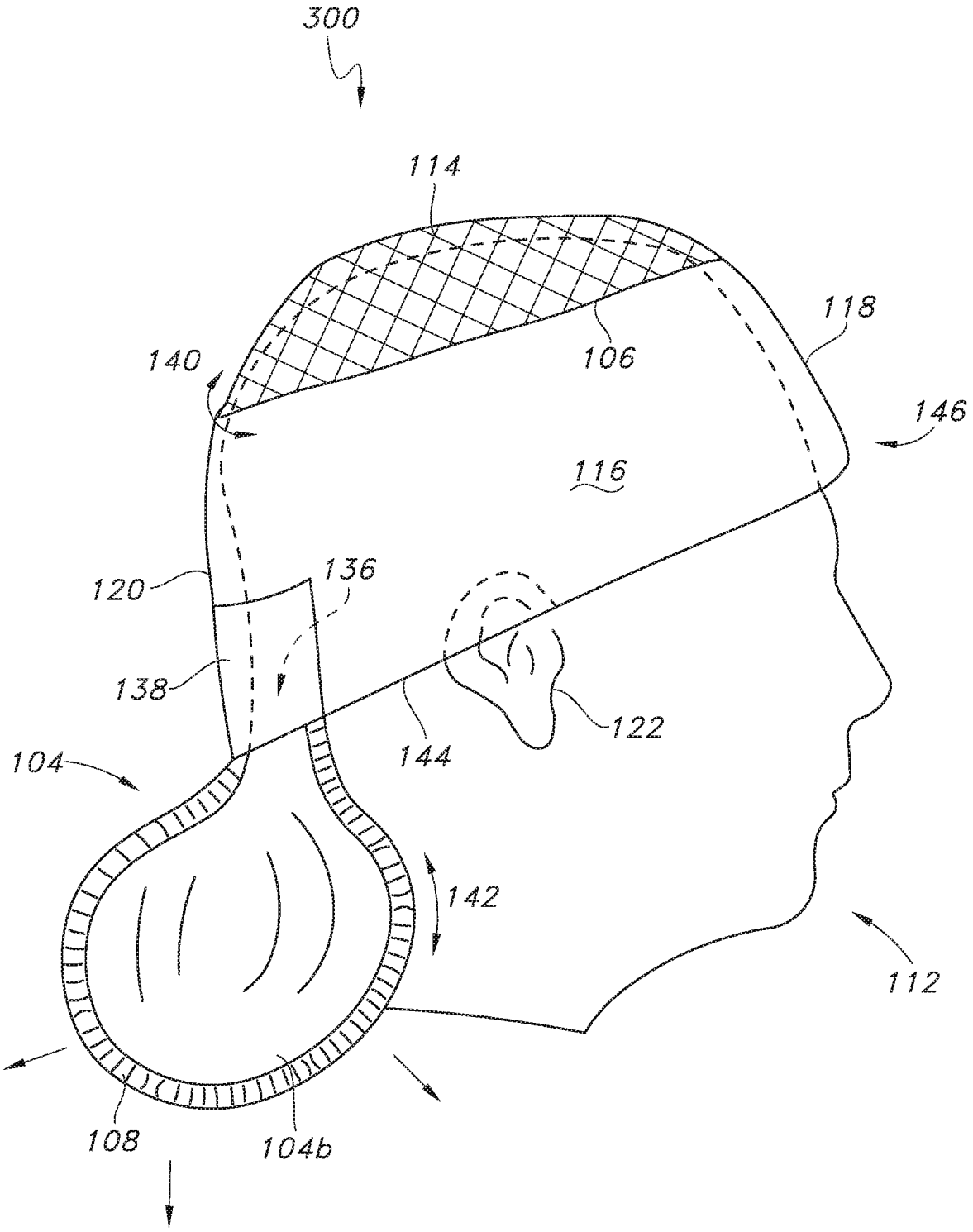
FIG. 7 is a side view of the head cover of FIG. 6 after the bouffant cap portion of the head cover has been deployed from a rear portion of a side panel of a surgical cap portion of the head cover.

FIG. 6 is a side view of the head cover 300 after it has been donned by a wearer 112, while FIG. 7 is a side view of the head cover 300 of FIG. 6 after the bouffant cap portion 104 of the head cover has been deployed from the posterior portion 120 of the surgical cap portion 102 of the head cover 100. As shown in FIG. 6, the side panel 116 is a continuous piece of material that wraps around the wearer 112's head 146 such that a fastening means 110 as in FIGS. 1-5 is not required to secure the head cover 300 on the wearer 112's head 146. Instead, the head cover 300 includes an elastic band 134 and pleats 126 formed in a securing rear portion 136 of the side panel 116 (see FIGS. 8, 9*a*, 9*b*, and 10) to ensure a secure fit around the wearer 112's head 146. In addition, the bouffant cap portion 104 is in an undeployed state 104*a* and is contained within the side panel 116 at edge 144 via an exterior flap 138 such that the bouffant cap portion 104 is not visible when in an undeployed state. As shown, the edge 144 of the side panel 116 can encircle the wearer 112's head and covers a portion of the wearer 112's ear 122.

Next, FIG. 7 shows the head cover 300 after the bouffant cap portion 104 has been used to contain the wearer 112's hair such that the bouffant cap portion 104 is in a deployed state 104*b*. As shown, the bouffant cap portion 104 extends below the exterior flap 138 beyond the edge 144 of the securing rear portion 136 of the side panel 116 so as to contain hair that may extend outside the surgical cap portion 102 of the head cover 300. The circumference 142 of the bouffant cap portion 104 contains gathers 108 that provide the bouffant cap portion 104 with some elasticity to enable the bouffant cap portion 104 to securely contain the wearer 112's hair. The bouffant cap portion 104 can be deployed in any suitable manner, such as by the wearer 112 reaching underneath the exterior flap 138 and grasping the gathers 108 and gently pulling downward to secure the bouffant cap portion 104 around his or her hair.

Figure 8:
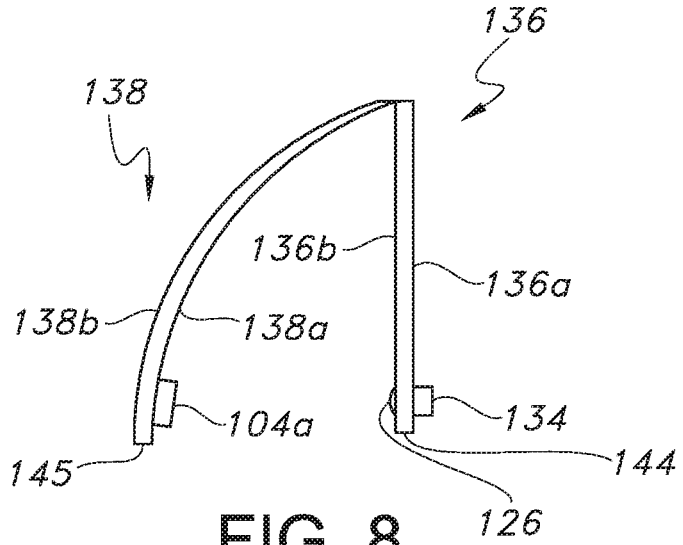
FIG. 8 is a cross-sectional view of part of the posterior portion of the head cover of FIG. 6, including an exterior flap and a securing rear portion of the side panel, where the exterior flap includes an undeployed bouffant cap portion and the securing rear portion includes an elastic band and pleats.

Referring now to FIGS. 8, 9*a* 9*b*, and 10, the securing rear portion 136 of the side panel 116 of FIGS. 6 and 7 is shown in more detail. Specifically, FIG. 8 is a cross-sectional view of part of the posterior portion 120 of the head cover 300 of FIG. 6, including an exterior flap 138 and a securing rear portion 136 of the side panel 116, where the exterior flap 138 includes an undeployed bouffant cap portion 104*a* and the securing rear portion 136 includes an elastic band 134 and a series of pleats 126.

As shown, the bouffant cap portion 104*a* of the head cover 300 is shown in FIG. 8 in its undeployed state 104*a* such that it is folded against a body-facing surface 138*a* of the exterior flap 138 adjacent a lower edge 145 of the exterior flap 138. As such, in its undeployed state, the bouffant cap portion 104*a* is not visible from the exterior-facing surface 138*b* of the exterior flap 138. The bouffant cap portion 104*a* can be secured near the lower edge 145 of the side panel 116 via any suitable attachment means 154 (see FIG. 10) such as a thread, an adhesive, etc. so long as the bouffant cap portion 104*a* can still be easily deployed from between the exterior flap 138 and the rear portion 136 of the side panel 116 when needed to contain a wearer 112's hair. Further, the securing rear portion 136 can include an elastic band 134 disposed on a body-facing surface 136*a* adjacent a lower edge 144 of the securing rear portion 136, while a series of pleats 126 can be formed on an exterior-facing surface 136*b* of the securing rear portion 136, where the elastic band 134 and pleats 126 enable the head cover 300 to be adequately secured about a wearer's head.

Figure 9A:
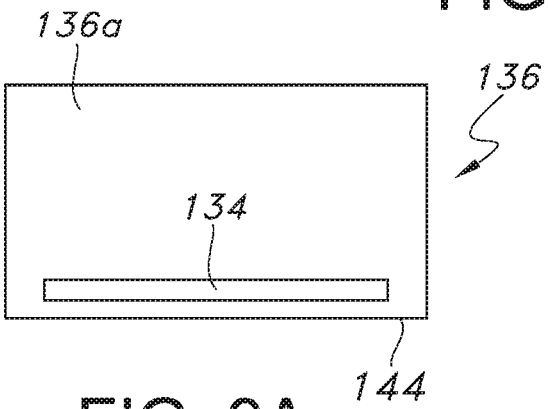
FIG. 9*a* shows a body-facing surface of the rear portion of the side panel of FIG. 8, which includes an elastic band used for securing the head cover about the head of the wearer.
Figure 9B:
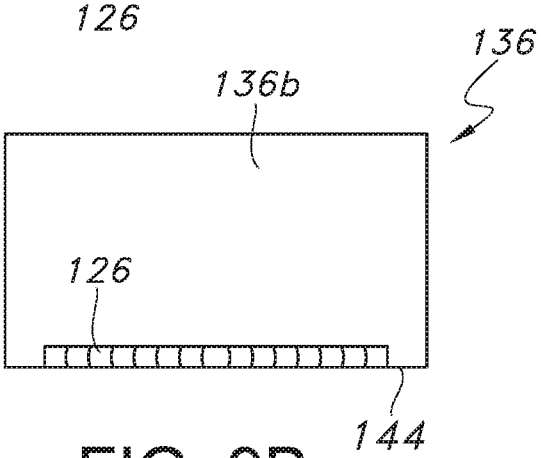
FIG. 9*b* shows an exterior-facing surface of the securing rear portion of the side panel of FIG. 8, which includes pleats.

Referring now to FIGS. 9*a* and 9*b*, FIG. 9*a* shows a body-facing surface 136*a* of the securing rear portion 136 of the side panel 116 of FIGS. 6-8, which includes an elastic band 134 used for securing the head cover 300 about the head 146 of the wearer 112. The elastic band 134 can be disposed adjacent an edge 144 of the body-facing surface 136*a* of the securing rear portion 136 of the side panel 116 in such a manner (e.g., by sewing) so that a series of pleats 126 are formed in the exterior-facing surface 136*b* of the securing rear portion 136 of the side panel 116 as shown in FIG. 9*b*. As such, a snug fit of the head cover 300 can be achieved, yet the elastic band 134 can stretch and, in turn, can stretch the series of pleats 126 to adjust the head cover 300 to fit wearers 112 having varying head circumferences.

Figure 10:
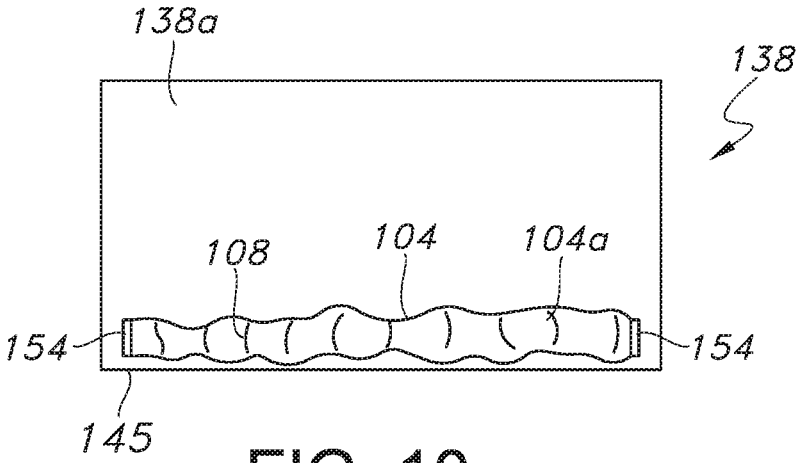
FIG. 10 shows a body-facing surface of the exterior flap shown in FIG. 8 to which is attached the bouffant cap portion of the head cover, where the bouffant cap portion is shown in its undeployed state.
Figure 11:
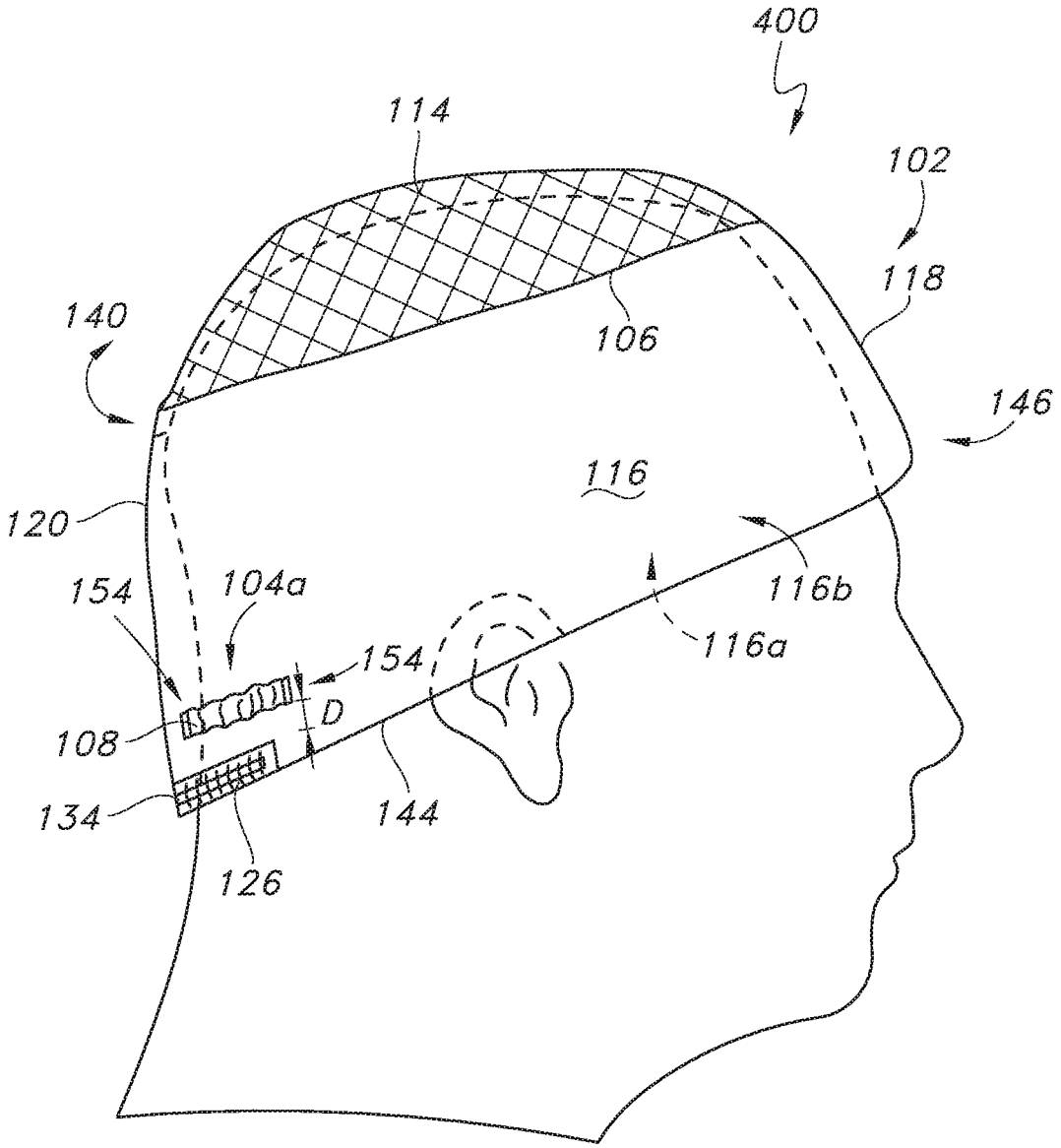
FIG. 11 is a side view of a head cover according to another particular embodiment of the present invention after the head cover has been donned by a wearer.
Figure 12:
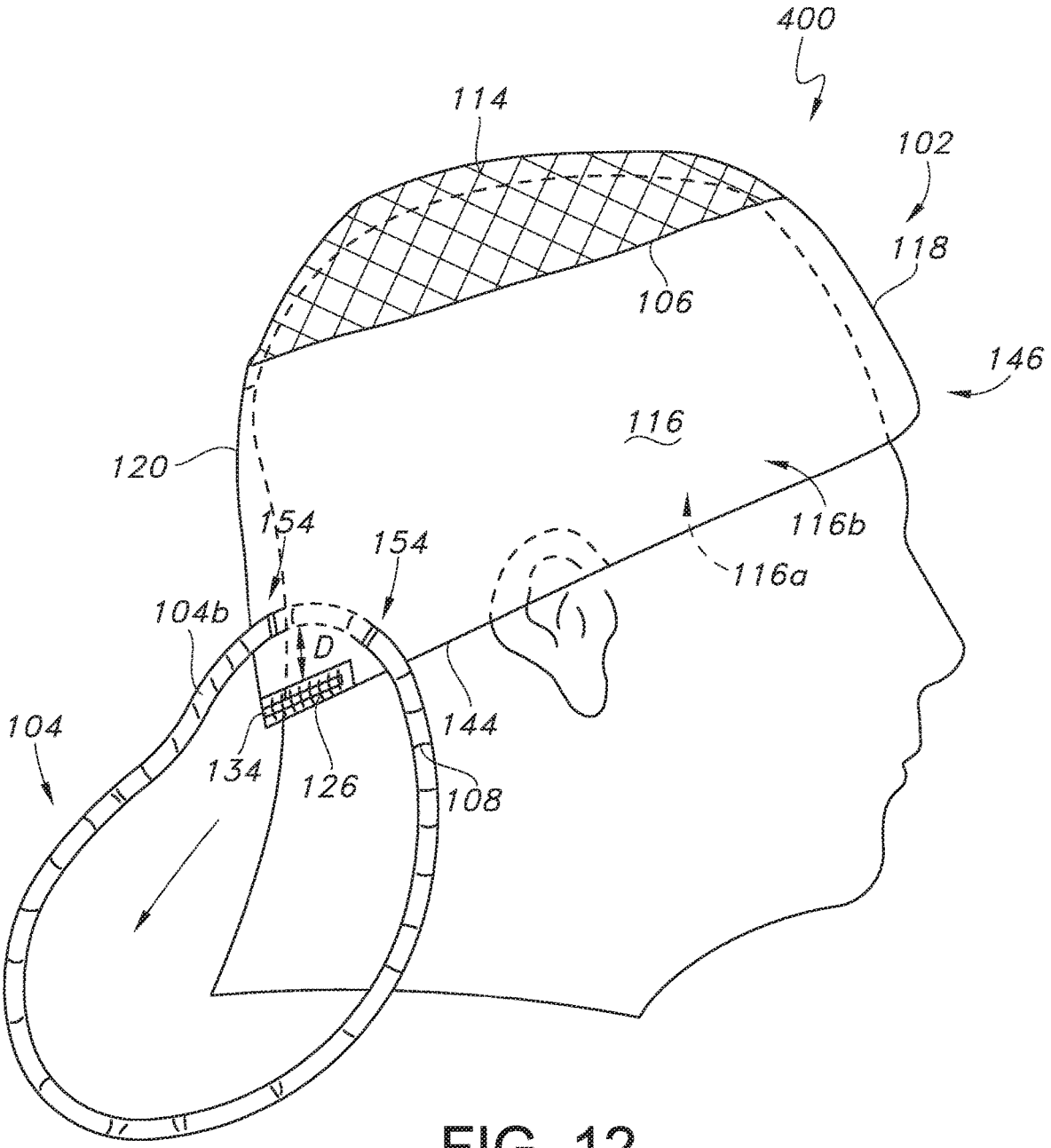
FIG. 12 is a side view of the head cover of FIG. 11 after the bouffant cap portion of the head cover has been deployed from a rear portion of a side panel of a surgical cap portion of the head cover.

FIG. 10 shows a body-facing surface 138*a* of the exterior flap 138 shown in FIGS. 6-8 to which is attached the bouffant cap portion 104 of the head cover, where the bouffant cap portion 104 is shown in its undeployed state 104*a*. The gathers 108 of the bouffant cap portion 104*a* can be grasped as needed and pulled downward to contain a wearer 112's hair as discussed above. Further, as shown in FIG. 10, the bouffant cap portion 104*a* can be secured near the lower edge 145 of the exterior flap via any suitable attachment means 154 (see FIG. 10) such as a thread, an adhesive, etc. so long as the bouffant cap portion 104*a* can still be easily deployed from between the exterior flap 138 and the rear portion 136 of the side panel 116 when needed to contain a wearer 112's hair Referring now to FIGS. 11-13, an additional embodiment of a head cover 400 is shown. Specifically, FIG. 11 is a side view of a head cover 400 according to another particular embodiment of the present invention after the head cover 400 has been donned by a wearer but before the bouffant cap portion 104*a* has been deployed. Meanwhile, FIG. 12 is a side view of the head cover 400 according to after the head cover 400 has been donned by a wearer but before the bouffant cap portion 104*b* has been deployed. As with head covers 100, 200, and 300, in addition to a bouffant cap portion 104, head cover 400 includes a surgical cap portion 102 and has an anterior portion 118 that is positioned about a forehead of a wearer and a posterior portion 120 that is positioned about the back of the head or neck of the wearer. The surgical cap portion 102 includes a top surface 114 and a side panel 116. In one embodiment, the top surface 114 and the side panel 116 can be joined together at a seam 106 that encircles the circumference 140 of the top surface 114. Further, the bouffant cap portion 104 is disposed adjacent a lower edge 144 of the side panel 116 at posterior portion 120 of the surgical cap portion 102 of the head cover 400 and can be secured to a body-facing surface 116*a* of the side panel 116 via attachment means 154 such that the bouffant cap portion 104 is not visible from the exterior-facing surface 116*b*. In addition, as shown, the undeployed bouffant cap portion 104*a* is spaced apart from and disposed above the elastic 134 and pleats 126 of the surgical cap portion 102, which are positioned adjacent a lower edge 144 of the side panel 116, by a distance D. The distance D can range from about 0.25 centimeters (cm) to about 6 cm, such as from about 0.5 cm to about 4 cm, such as from about 0.75 cm to about 2 cm, such as from about 1 cm to about 1.5 cm. The present inventors have found that such a configuration allows for easier deployment of the bouffant cap portion 104 because interference from the elastic 134 present on the body-facing surface 116*a* and the pleats 126 present on the exterior-facing surface 116*b* is minimized.

Figure 13:
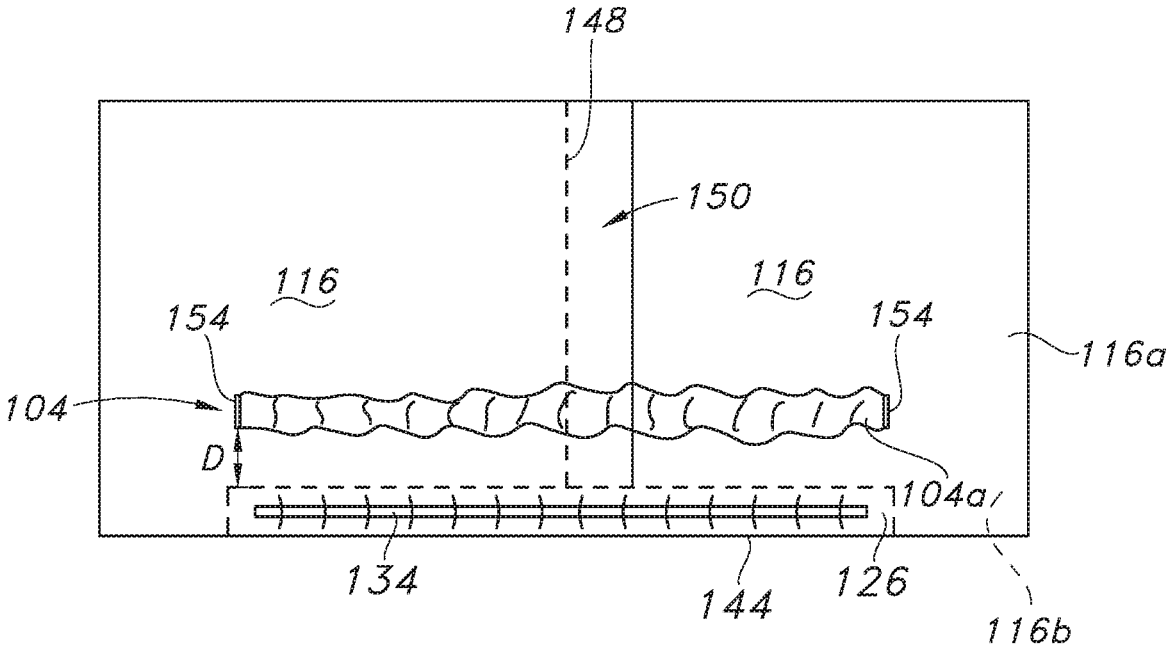
FIG. 13 shows a body-facing surface and an exterior facing surface (refer to dotted lines) of the posterior portion of the head cover of FIG. 11, where the bouffant cap portion of the head cover is shown in its undeployed state

FIG. 13 shows a body-facing surface 116*a* and an exterior-facing surface 116*b* (refer to dotted lines) of the posterior portion 120 of the head cover 400 of FIGS. 11-12 in more detail, where the bouffant cap portion 104*a* of the head cover 400 is shown in its undeployed state, where the side panels 116 are joined together at a seam 148, where the side panels 116 may have an overlapping portion 150. As shown, the elastic 134 is present on the body-facing surface 116*a* while the pleats 126 (refer to dotted lines) are present on the exterior-facing surface 116*b* near the lower edge 144 of the side panel 116. Further, the distance D between the series of pleats 126/elastic 134 and the bouffant cap portion 104 is shown in more detail.

Figure 14:
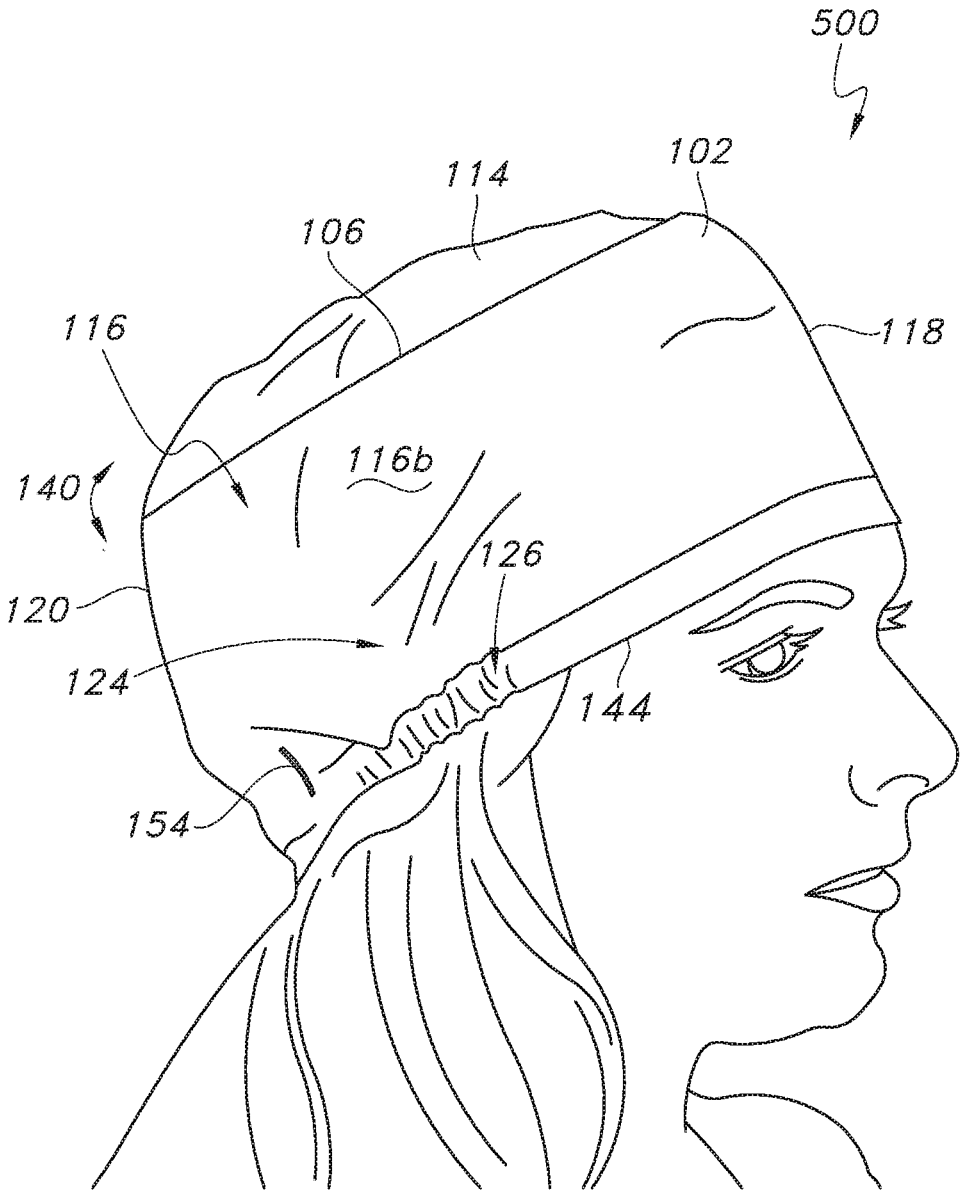
FIG. 14 is a side view of a head cover according to another particular embodiment of the present invention after the head cover has been donned by a wearer.
Figure 15:
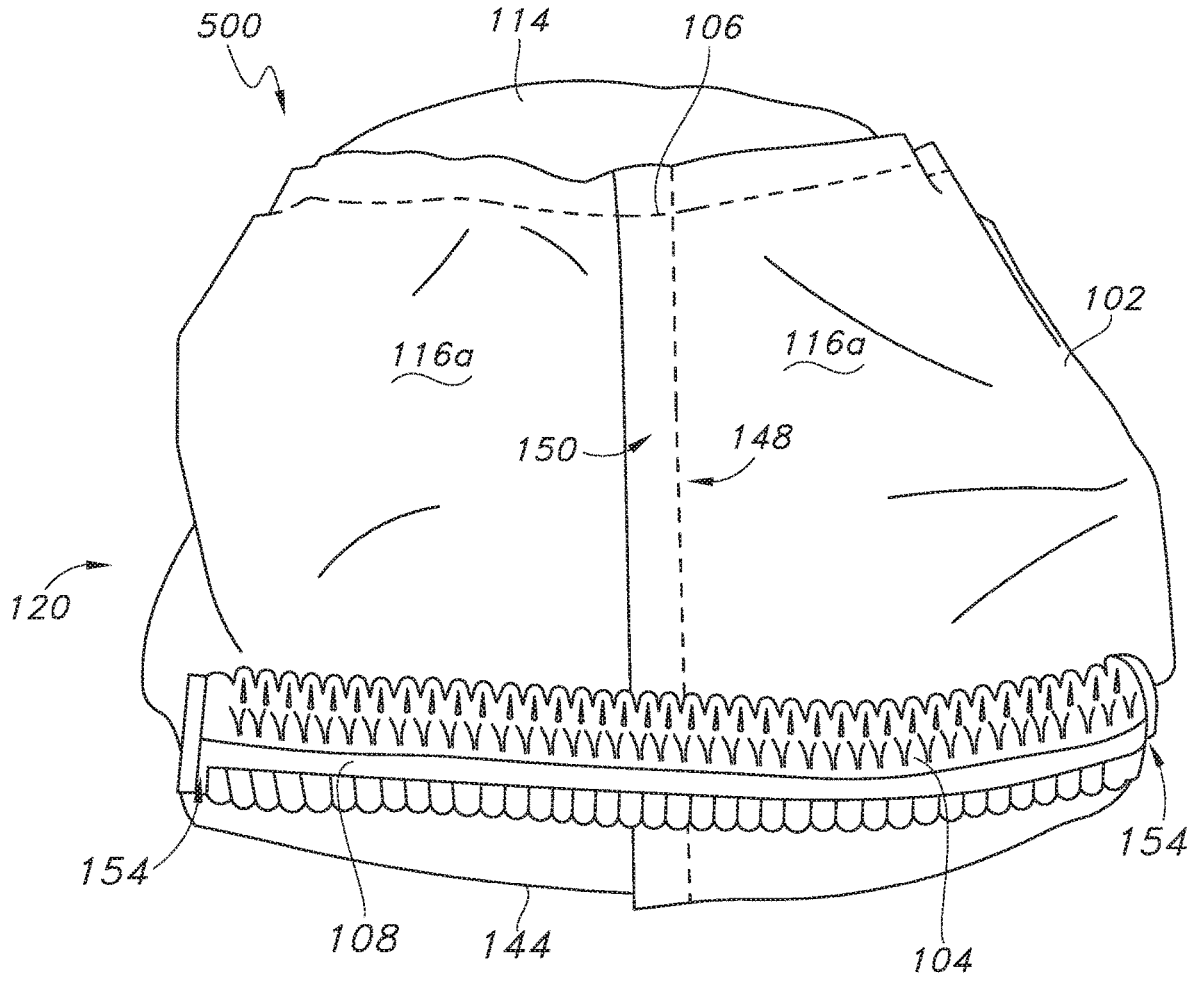
FIG. 15 shows a body-facing surface of the posterior portion of the head cover of FIG. 14, where the bouffant cap portion of the head cover is shown in its undeployed state.
Figure 16:
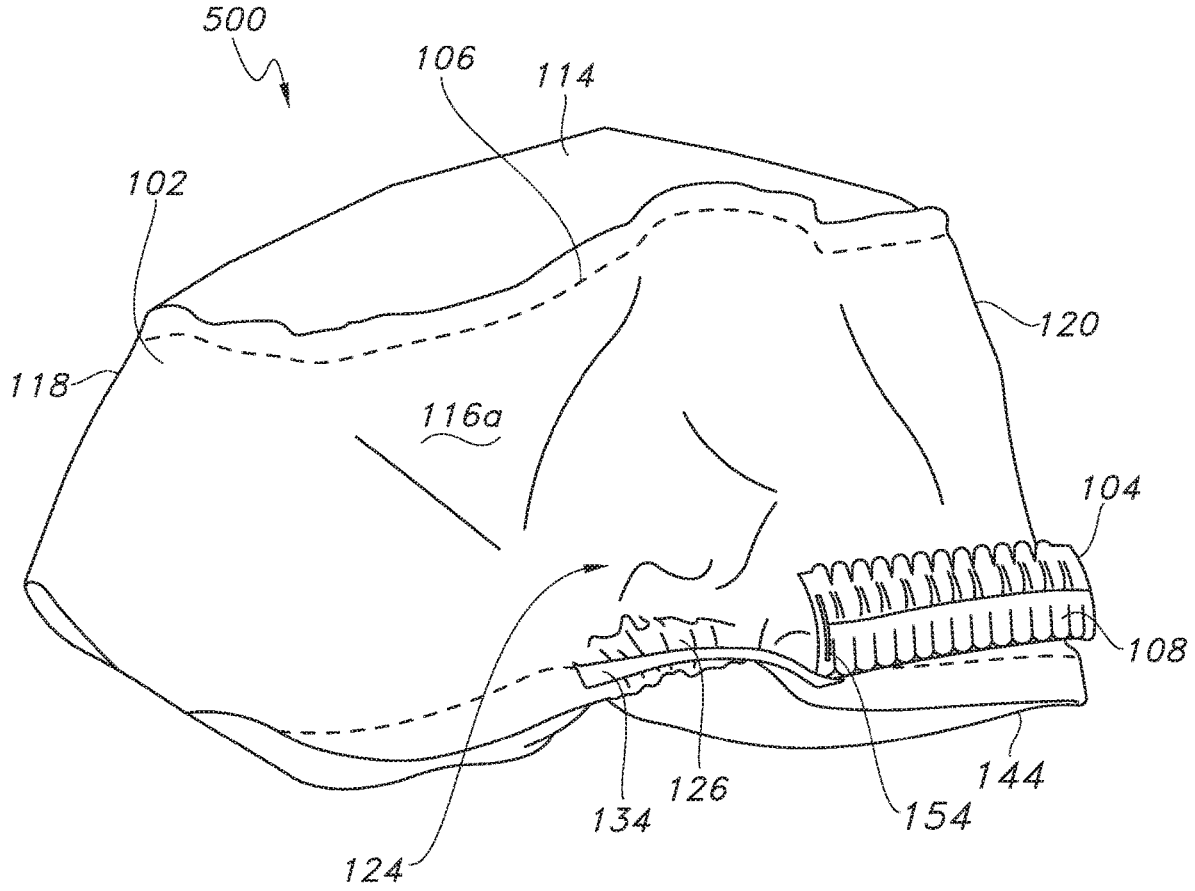
FIG. 16 shows a body-facing surface of side panels of the head cover of FIG. 14, where the bouffant cap portion of the head cover is shown in its undeployed state.

Referring now to FIGS. 14-16, another embodiment of a head cover 500 is shown. FIG. 14 is a side view of the head cover 500 according to another particular embodiment of the present invention after the head cover 400 has been donned by a wearer but before the bouffant cap portion 104*a* (not shown, see FIGS. 15-16) has been deployed. The head cover 500 includes a surgical cap portion 102 and has an anterior portion 118 that is positioned about a forehead of a wearer and a posterior portion 120 that is positioned about the back of the head or neck of the wearer. The surgical cap portion 102 includes a top surface 114 and a side panel 116. In one embodiment, the top surface 114 and the side panel 116 can be joined together at a seam 106 that encircles the circumference 140 of the top surface 114. Further, the bouffant cap portion 104 is disposed adjacent a lower edge 144 of the side panel 116 at posterior portion 120 of the surgical cap portion 102 of the head cover 400 and can be secured to a body-facing surface 116*a* (see FIG. 15) of the side panel 116 via attachment means 154 such that the bouffant cap portion 104 is not visible from the exterior-facing surface 116*b*.

In addition, as shown a series of pleats 126 can be present on the exterior-facing surface 116*b* of the side panel below an ear portion 124 of the side panel 116 and adjacent a lower edge 144 of the side panel 116. In addition, and referring to FIGS. 15 and 16, which illustrate the head cover 500 turned inside out so that the body-facing surface 116*a* of the side panel 116 is shown, the elastic 134 can also be present below an ear portion 124 of the side panel 116 but on the body-facing surface 116*a*. In this manner, both the series of pleats 126 and the elastic 134 are separated from the bouffant cap portion 104 at the posterior portion 120 of the surgical cap portion 102 to prevent the elastic 134 and series of pleats 126 from interfering with the deployment of the bouffant cap portion 104 while at the same time facilitating a secure fit of the head cover 500 about the wearer's head. As shown in FIGS. 14-16, the bouffant cap portion 104 is attached to the side panel 116 via attachments means 154, where the bouffant cap portion 104 is not in contact with the elastic 134 or the pleats 126. Further, although not shown, it is to be understood that the bouffant cap portion 104 of FIGS. 14-16 can be deployed in any manner as discussed above.

Figure 17:
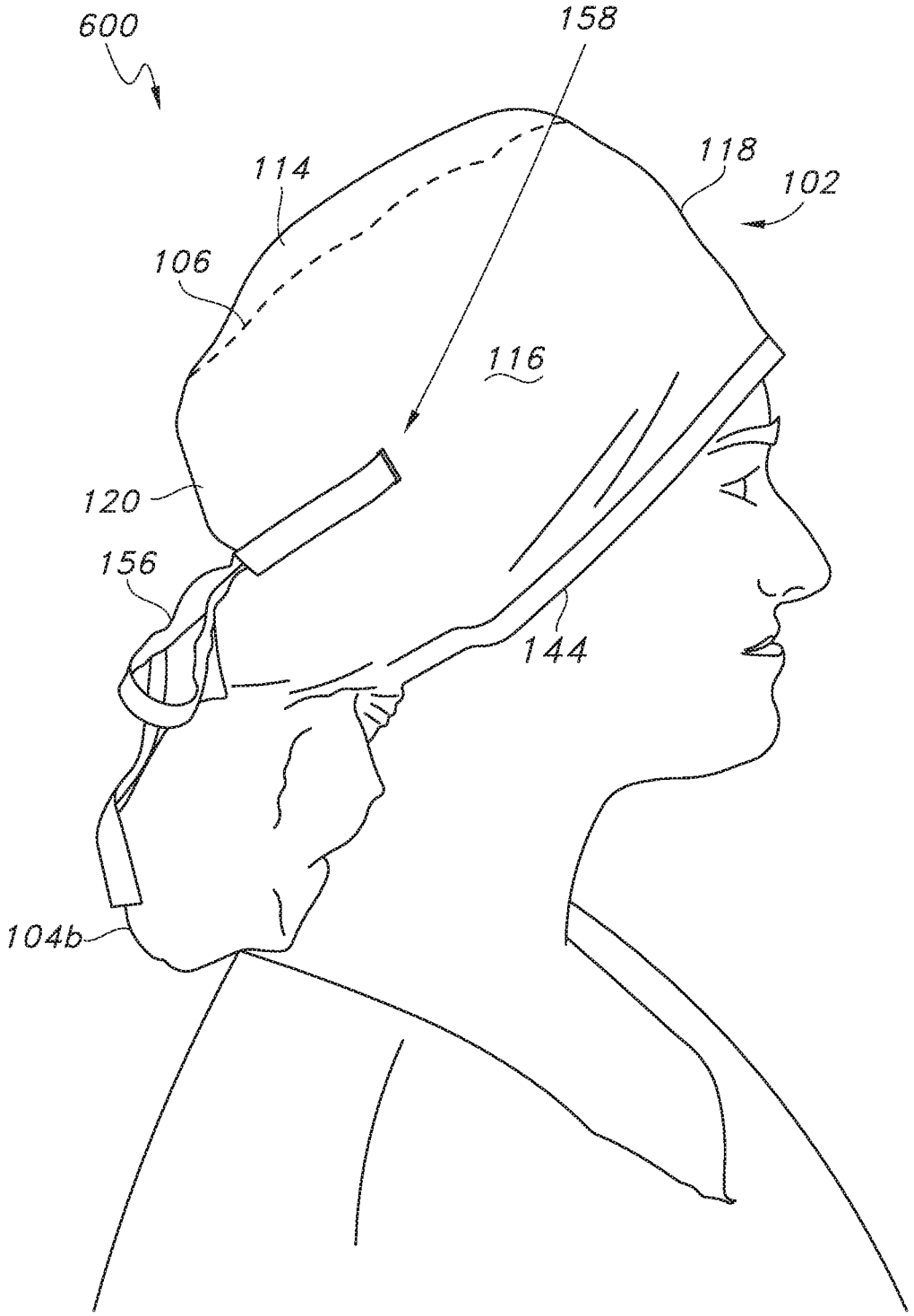
FIG. 17 is a side view of the head cover according to another particular embodiment of the present invention after the bouffant cap portion of the head cover has been deployed from a rear portion of the surgical cap portion of the head cover, where the side panel includes a pair of ties.
Figure 18:
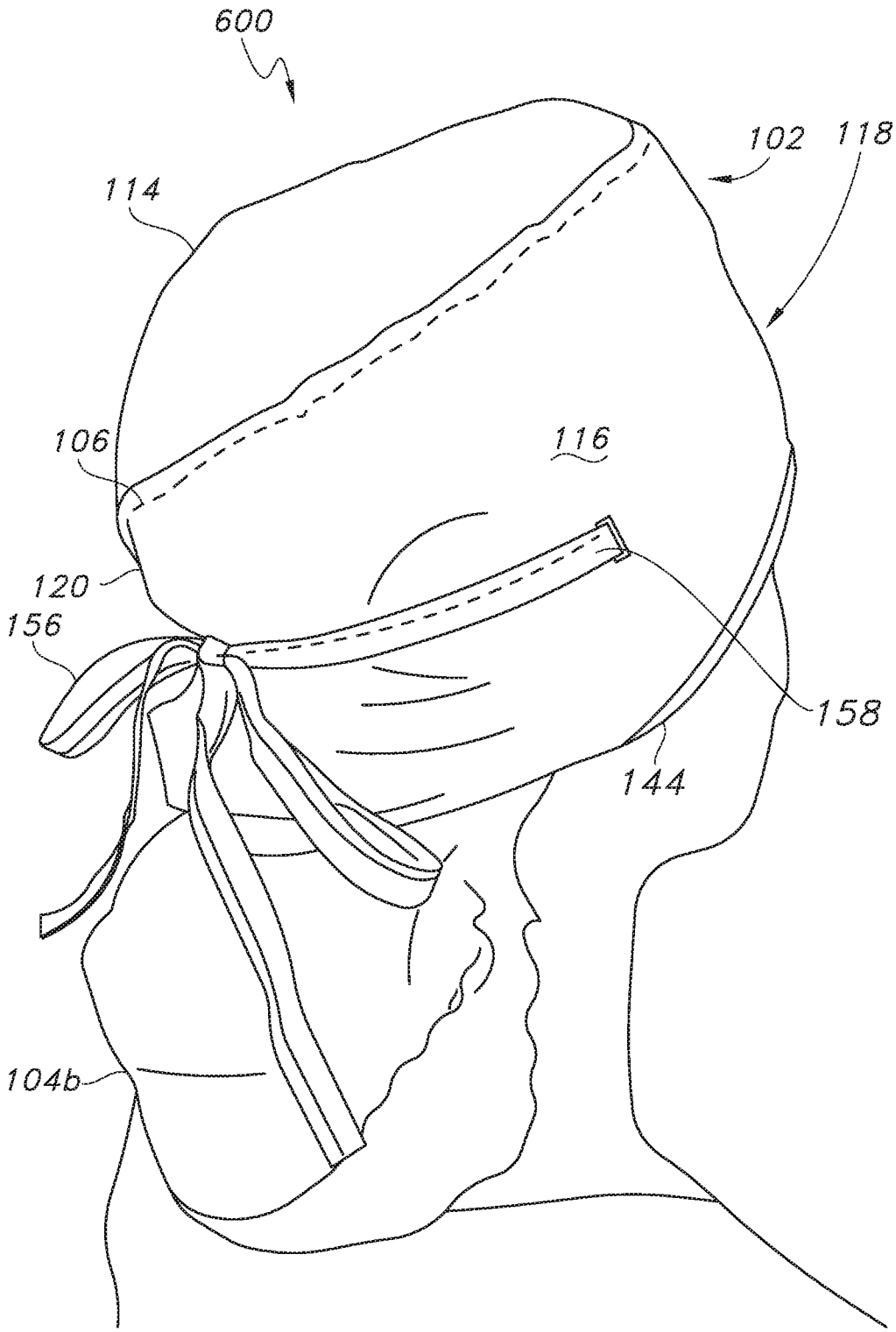
FIG. 18 is a rear-side view of the head cover of FIG. 17 after the bouffant cap portion of the head cover has been deployed from a rear portion of the surgical cap portion of the head cover, where the side panel includes a pair of ties.
Figure 19:
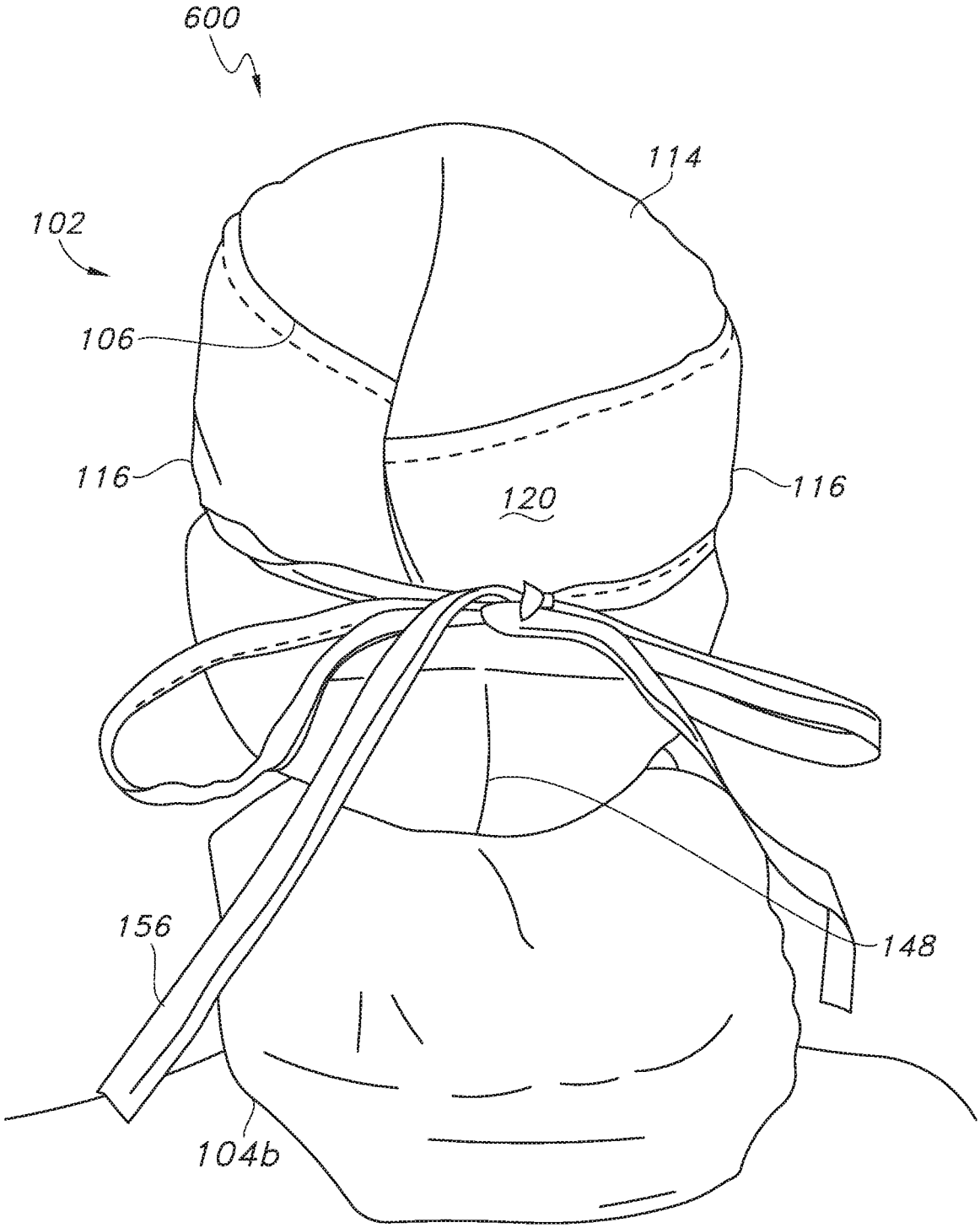
FIG. 19 is a rear view of the head cover of FIG. 17 after the bouffant cap portion of the head cover has been deployed from a rear portion of the surgical cap portion of the head cover, where the side panel includes a pair of ties.

Referring now to FIGS. 17-19, another embodiment of a head cover 600 contemplated by the present invention is shown. Specifically, FIG. 17 is a side view of a head cover 600 according to another particular embodiment of the present invention illustrating a deployed bouffant cap portion 104*b* at the rear portion 120 of the surgical cap portion 102 of the head cover 600, where the side panel 116 includes a pair of ties 156. Although only one tie 156 is shown in FIG. 17, it is to be understood that the opposing portion of the side panel 116 also includes a tie 156. The pair of ties 156 can be secured to the side panel 116 via a seam 158 or any other suitable attachment means such as an adhesive, hook and loop closures, ultrasonic bonding, double-sided tape, etc. FIG. 18 illustrates a rear-side view of the head cover 600 of FIG. 17 showing the pair of ties 156 secured about the rear portion 120 of the surgical cap portion 102 of the head cover 600. Meanwhile, FIG. 19 is a rear view of the head cover 600 of FIG. 17 showing how the seam 148 is not visible along the entire surgical cap portion 102, as part of the side panels 112 at the rear portion 120 of the surgical cap portion 102 is folded over itself as a result of the secure fit provided by the pair of ties 156.

Figure 20:
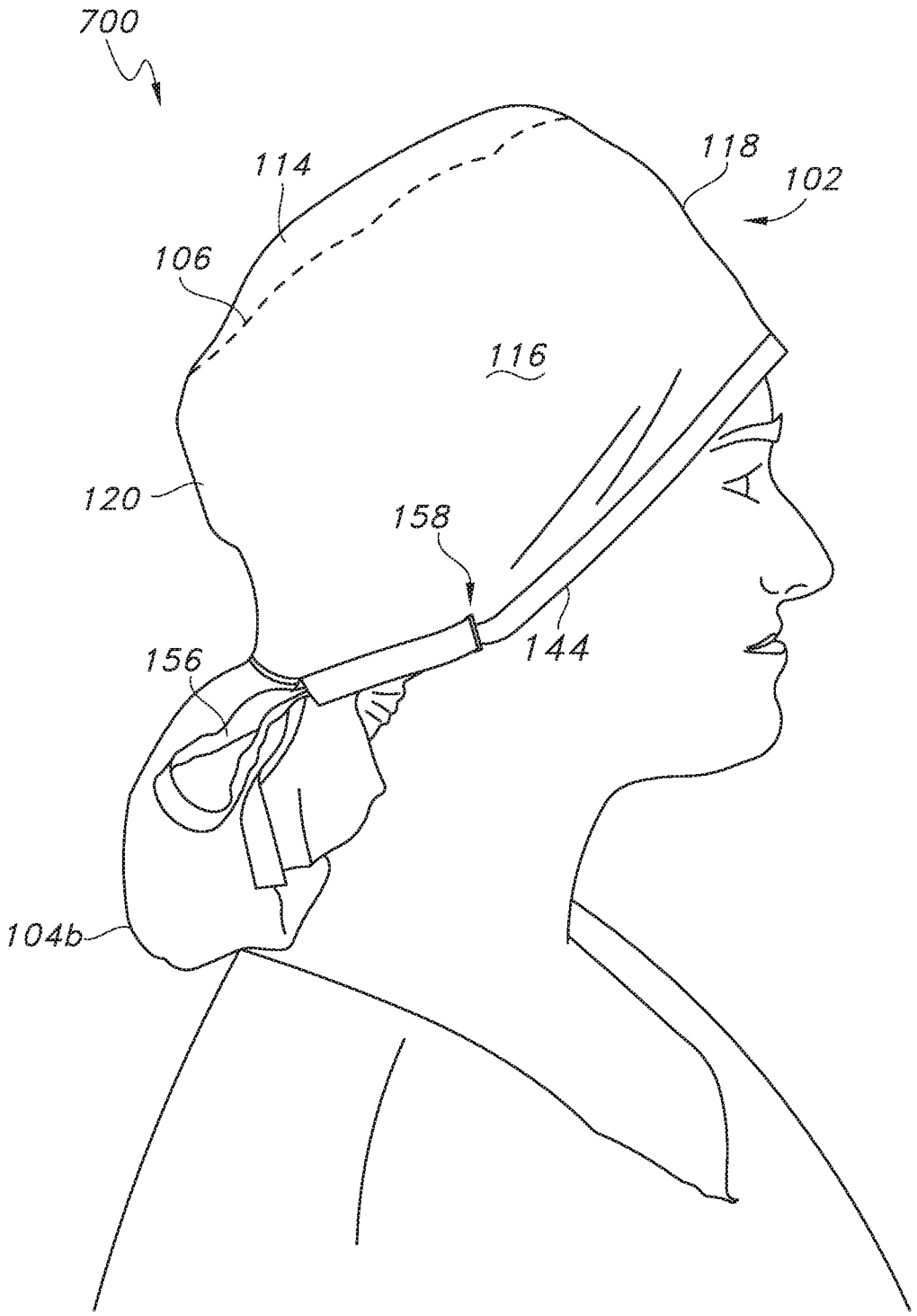
FIG. 20 is a side view of the head cover according to another particular embodiment of the present invention after the bouffant cap portion of the head cover has been deployed from a rear portion of the surgical cap portion of the head cover, where the side panel includes a pair of ties disposed at a lower edge of the side panel.

Further, FIG. 20 is a side view of a head cover 700 according to another particular embodiment of the present invention illustrating a deployed bouffant cap portion 104*b* at the rear portion 120 of the surgical cap portion 102 of the head cover 600, where the side panel 116 includes a pair of ties 156. Although only one tie 156 is shown in FIG. 17, it is to be understood that the opposing portion of the side panel 116 also includes a tie 156. The pair of ties 156 can be secured to a lower edge 144 of the side panel 116 via a seam 158 or any other suitable attachment means such as an adhesive, hook and loop closures, ultrasonic bonding, double-sided tape, etc.

Without intending to be limited by any particular theory, the present inventors have found that the pair of ties 156 can increase the security of the head cover 600 on the wearer's head. It is believed that the added tension from the pair of ties 156 helps to secure the head cover 600 against the wearer's forehead and prevent the head cover 600 from sliding up or down during use, while at the same time not being too tight or uncomfortable.

Regardless of the particular configuration of the surgical cap portion 102 and bouffant cap portion 104 of the head cover 100, 200, 300, 400, 500, or 600 of the present invention, the materials used to form the surgical cap portion 102 and bouffant cap portion 104 can be chose to maximize the comfort to the wearer. For instance, the top surface 114 and the side panel 116 of the surgical cap portion 102 can be made from a variety of nonwoven materials formed by any number of processes including, but not limited to, air laying processes, wet laid processes, hydroentangling processes, spunbonding, meltblowing, staple fiber carding and bonding, and solution spinning. The fibers in the nonwoven materials themselves can be made from a variety of both natural and synthetic materials including, but not limited to, cellulose, rayon, nylon, polyesters, polyolefins, and many other materials. The fibers may be relatively short, staple length fibers, typically less than three inches, or longer and substantially more continuous fibers such as are produced by spunbonding and meltblowing processes.

In one particular embodiment, the top surface 114 of the surgical cap portion 102 and the bouffant cap portion 104 can be formed from a spunbond material to facilitate air flow and minimize the amount of heat trapped within the head cover 100, 200, or 300. In addition, the ear portion(s) 124 of the side panel 116 can also be formed from a spunbond material. Meanwhile, the side panel 116 of the surgical cap portion 102 can be formed from a laminate material such as a spunbond-meltblown-spunbond material is made from three separate layers that are laminated to one another in order to provide sufficient structure to support a headlamp or any other accessories that might be worn about the crown of the head by a health care professional. The method of making the aforementioned materials is known and described in U.S. Pat. No. 4,041,203 to Brock, et al., which is incorporated herein in its entirety by reference. The material of Brock, et al. is a three layer laminate of spunbond-meltblown-spunbond layers that is also commonly referred to by the acronym "SMS." The two outer layers of SMS are a spunbond material made from extruded polyolefin fibers, or filaments, laid down in a random pattern and then bonded to one another. The inner layer is a meltblown layer also made from extruded polyolefin fibers generally of a smaller diameter than the fibers in the spunbond layers. As a result, the meltblown layer provides increased barrier properties due to its fine fiber structure, which permits the sterilizing agent to pass through the fabric while preventing passage of bacteria and other contaminants. Conversely, the two outer spunbond layers provide a greater portion of the strength factor in the overall laminate. The laminate may be prepared using an intermittent bond pattern that is preferably employed with the pattern being substantially regularly repeating over the surface of the laminate. The pattern is selected such that the bonds may occupy about 5% to about 50% of the surface area of the laminate. Desirably, the bonds may occupy about 10% to about 30% of the surface area of the laminate. Further, although the head cover 100, 200, or 300 is described above as being formed from a combination of spunbond and SMS materials, is to be understood that the different portions of the head cover 100, 200, or 300 can be made from any other suitable materials that minimize the trapping of heat yet provide sufficient structure as needed. For instance, in addition to the spunbond or SMS materials described above, any or all of the portions of the surgical cap portion 102 (e.g., the top surface 114, the side panel 116, and/or the ear portion 124) can be formed from a woven cotton material.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A head cover comprising:

a surgical cap portion, wherein the surgical cap portion comprises a top surface and a side panel secured to the top surface via a seam, wherein a series of pleats is present at a lower edge of the side panel; and a bouffant cap portion, wherein the bouffant cap portion is secured to a rear portion of the side panel adjacent the lower edge of the side panel, wherein the bouffant cap portion is maintained against the rear portion of the side panel in an undeployed state and is deployable from the rear portion of the side panel to contain a wearer's hair, further wherein the series of pleats are separated from the bouffant cap portion at the rear portion.

2. The head cover of claim 1, wherein the side panel is a continuous section of material that completely encircles the circumference of the top surface, further wherein an elastic band is present adjacent the lower edge of the side panel.

3. The head cover of claim 2, wherein the series of pleats, the elastic band, or both are present at the rear portion of the side panel or below an ear portion of the side panel.

4. The head cover of claim 3, wherein the series of pleats, the elastic band, or both are present at the rear portion of the side panel, further wherein the bouffant cap portion is positioned above the elastic band, the series of pleats, or both by a distance D.

5. The head cover of claim 4, wherein the distance D ranges from about 0.25 centimeters (cm) to about 6 cm.

6. The head cover of claim 1, wherein an exterior flap contains the bouffant cap portion of the head cover until the bouffant cap portion of the head cover is deployed.

7. The head cover of claim 1, wherein the side panel extends between a first end and a second end, wherein a fastening means is disposed on the first end or the second end.

8. The head cover of claim 7, wherein the fastening means comprises hooks, loops, or a combination thereof.

9. The head cover of claim 1, wherein the bouffant cap portion has a circumference, wherein a series of gathers are present at the circumference of the bouffant cap portion.

10. The head cover of claim 9, wherein a part of the circumference of the bouffant cap portion is secured to a body-facing surface of the rear portion of the side panel.

11. The head cover of claim 1, wherein the top surface of the surgical cap portion is adjacent the wearer's head.

12. The head cover of claim 1, wherein the bouffant cap portion of the head cover and the top surface of the surgical cap portion do not overlap.

13. The head cover of claim 1, wherein the bouffant cap portion of the head cover is not visible until it is deployed.

14. The head cover of claim 1, wherein the side panel of the surgical cap portion comprises a laminate.

15. The head cover of claim 14, wherein the laminate comprises a spunbond-meltblown-spunbond material.

16. The head cover of claim 1, wherein the side panel of the surgical cap comprises a spunbond material or a cotton woven material.

17. The head cover of claim 1, wherein the top surface of the surgical cap portion comprises a spunbond material, a spunbond-meltblown-spunbond material, or a cotton woven material.

18. The head cover of claim 1, wherein the bouffant cap portion comprises a spunbond material.

19. The head cover of claim 1, wherein the side panel extends beyond the wearer's ears.

20. The head cover of claim 19, wherein a portion of the side panel covering the wearer's ears comprises a spunbond material, a spunbond-meltblown-spunbond material, or a cotton woven material.

21. The head cover of claim 1, wherein a pair of ties is disposed on the side panel.

* * * * *